United States Patent [19]

Repa

[11] Patent Number: 4,815,217

[45] Date of Patent: Mar. 28, 1989

[54] ORTHOGONAL ADJUSTING MECHANISM AND ORTHOGONALLY ADJUSTABLE SIGHT

[75] Inventor: Otto Repa, Oberndorf/BRD, Fed. Rep. of Germany

[73] Assignee: Steyr-Daimler-Puch Aktiengesellschaft, Vienna, Austria

[21] Appl. No.: 70,918

[22] Filed: Jul. 9, 1987

[30] Foreign Application Priority Data

Jul. 15, 1986 [AT] Austria ..... 1919/86

[51] Int. Cl.[4] ..... F41G 1/02

[52] U.S. Cl. ..... 33/257; 74/479; 248/183

[58] Field of Search ..... 74/89.15, 471 XY, 479, 74/804, 805; 33/233, 234, 235, 247, 248, 252, 257, 258, 259, 260; 384/612, 613, 616; 248/178, 184, 183, 274, 287; 403/80, 81, 110; 350/531

[56] References Cited

U.S. PATENT DOCUMENTS

| | | | |
|---|---|---|---|
| 366,748 | 7/1887 | Wells | 384/616 |
| 763,348 | 6/1904 | Andrews | 33/258 |
| 858,297 | 6/1907 | Latimer | 33/252 |
| 2,645,855 | 7/1953 | Ivy | 33/248 |
| 2,728,556 | 12/1955 | House | 74/89.15 |
| 3,002,429 | 10/1961 | Franke et al. | 384/616 |
| 4,006,645 | 2/1977 | Newell | 74/479 |
| 4,542,664 | 9/1985 | Sladek et al. | 74/804 |
| 4,554,745 | 11/1985 | Repa | 33/257 |

FOREIGN PATENT DOCUMENTS

| | | | |
|---|---|---|---|
| 832338 | 2/1952 | Fed. Rep. of Germany | 33/257 |
| 516946 | 4/1921 | France | 384/613 |
| 58-106514 | 6/1983 | Japan | 74/479 |

*Primary Examiner*—Allan D. Herrmann

*Attorney, Agent, or Firm*—Marmorek, Guttman & Rubenstein

[57] ABSTRACT

An orthogonally adjustable sight, particularly for rifles, comprises a housing (1), in which a carrier (2) for an eyepiece consisting, e.g., of a peephole sight (3), is mounted for an adjustment in two orthogonal directions. Actuators (4, 5) are provided for adjusting said eyepiece carrier (2) in said two orthogonal directions and are supported in the housing (1). To permit a highly exact adjustment which can easily be effected, the eyepiece carrier (2) comprises a guided plate (6), which has parallel planar surfaces on opposite sides and extends in the plane which is defined by the axes of the actuators (4, 5). The guided plate (6) is adapted to be gripped between two guided surfaces (8*a*, 9*a*), which are parallel to the guided plate (6). A polygonal array of balls (7) is interposed between the guided plate (6) and each of said guiding surfaces (8*a*, 9*a*).

13 Claims, 3 Drawing Sheets

ORTHOGONAL ADJUSTING MECHANISM AND ORTHOGONALLY ADJUSTABLE SIGHT

BACKGROUND OF THE INVENTION

1. Field of the Invention

This invention relates to an othogonal adjusting mechanism comprising a frame, an adjustable member, which defines an adjusting plane and is mounted in said frame for a movement relative to said frame in said plane at least in two orthogonal directions, and two actuators, which are mounted on said frame and coupled to said adjustable member and operable to move said adjustable member in two orthogonal directions in said adjusting plane relative to said frame.

In a special aspect this invention relates to the application of such orthogonal adjusting mechanism to an orthogonally adjustable sight, particularly for rifles, comprising an eyepiece carrier, which is mounted in a housing for a guided movement in two orthogonal directions which are transverse to a sight line, an eyepiece, e.g., a peephole sight, which is mounted on said carrier, and two actuators, which are mounted in the housing and are operable to adjust the carrier in said two directions.

2. Description of the Prior Art

In various sights, particularly in rifle sights, it is necessary for an adjustment, for a correction of the point of impact, for adaptation to changing conditions and for other reasons to adjust a peephole sight or another eye-piece in height and laterally so that the desired sight line is obtained, which extends from the eye through the rear sight and the front sight to the target. It is desired to perform relatively small adjustments with an extremely high precision by adjusting means which can easily be operated. Said requirements are not adequately complied with by the known sights, in which the eyepiece carriers consist in most cases of compound slides having dovetail and/or rod tracks, i.e., slide tracks which will not be operable unless they have a certain backlash so that the adjustment cannot be performed as easily as desired. Besides, said known sights involve a rather high structural expenditure because an excessive backlash inevitably results from the manufacture and must be eliminated by additional pressure-applying elements, wedges and associated screw drives. Moreover, the compound slides and their slide tracks can be manufactured only at high cost and the entire sight has a rather large space requirement.

It has also been proposed to provide an elongate tubular eyepiece carrier, which is supported at one end by means of a universal joint and is pivoted at the other hand to the actuators so that a fairly exact adjustment is permitted owing to the leverages which are provided. But that known sight has the disadvantage that the universal joint is liable to be deranged, that the assembly has a large overall length and that the design precludes the use of conventional accessories for the sight, such as different peephole sights, filters, and the like.

SUMMARY OF THE INVENTION

It is an object of the invention to eliminate said disadvantages and to provide an orthogonal adjusting mechanism which is of the kind described first hereinbefore and has a simple and rugged structure and can easily be adjusted.

It is another object of the invention to provide an orthogonally adjustable sight with which the foregoing object is accomplished and which can be provided with commercially available eyepieces and accessories.

In a sight, said objects are accomplished in accordance with the invention in that the eyepiece carrier comprises a guided plate, which extends and is adjustable in an adjusting plane and has plane parallel surfaces on opposite sides and is adapted to be gripped between two guiding surfaces, which are parallel to the guided plate, and a polygonal array of balls is interposed between the guided plate and each of said guiding surfaces. The polygonal array of balls disposed between the guided plate and each of the guide surfaces ensures that the adjustment will involve only rolling friction rather than sliding friction so that the guided plate and the guiding surfaces can be forced against each other so strongly that the guided plate can easily be adjusted and will be guided during such adjustment without any backlash. Only a single guided plate is provided, which is moved in the two directions of adjustment as desired, and the guiding means consist only of parts which have been machined on a lathe in an economical manner with the desired precision. That arrangement wil ensure an exact guidance and represents a low-cost structure, which is compact and rugged and not liable to be deranged. Because the design of the guided plate does not depend on the type of the eyepiece carrier, it is possible to use eyepiece carriers which can be provided with conventional eyepieces and accessories. For instance, the eyepiece carrier associated with a circular guided plate may consist of a hublike socket, which is coaxial to such guided plate and accommodates the eyepiece and the accessories. There is no restriction of the field of use of the sight.

It will be desirable to provide two backing plates, which constitute the guiding surfaces, and in a preferred arrangement one of said backing plates is fixedly supported in the housing and the other backing plate is mounted in the housing by means of screw threads permitting an adjustment of said backing plate for an application of pressure. Such backing plates can be machined with higher precision and economy than the housing and can be provided with exact guiding surfaces. Besides, said backing plates can be made of a suitable material which is capable of taking up the pressure applied by the balls. Besides, the backing plates can easily be accommodated in the housing and can be forced against each other in order to grip the guided plate between the polygonal arrays of balls. This can be accomplished, for instance, in that one of the backing plates is fixedly supported in the housing and the other pressure plate can be screwed into the housing by suitable screw threads. Such an arrangement will also facilitate the assembling and disassembling of the sight and will permit the eyepiece carrier to be initially adjusted and to be re-adjusted whenever this is desired.

If the actuators consist of adjusting screws and backlash-compensating spring means are arranged to bias the guided plate, it will be desirable within the scope of the invention to provide each adjusting screw with an inner end face that is normal to the axis of the screw and engages the peripheral surface of the guided plate and a compensating spring may extend substantially along the bisector of the angle that is included by the axes of said adjusting screws and may be arranged to urge the peripheral surface of the guided plate against said inner end faces of both said screws. In that case a single compensating spring will be sufficient to compensate the backlash of both actuators and such compensating spring will ensure that the peripheral surface of the guided plate will always snugly engage the inner end faces of the adjusting screws and will urge the guided plate to follow up the adjusting screws as they are retracted. The initial stress of the compensating spring is preferably adjustable so that the ease with which the adjusting screws are operable and the precision of the adjustment can be adjusted with said initial stress.

In a preferred embodiment of the invention each of said polygonal arrays of balls consists of at least three balls, which are held in an annular cage, and each of the polygonal arrays of bells extends into a circular recess that is formed in the associated backing plate and has a bottom which constitutes one of the guiding surfaces. At least three balls per polygonal array are required for a support which will prevent a tilting of the guided plate. The insertion of the polygonal array of balls into a recess of the backing plate will facilitate the assembling because each polygonal array of balls and the associated backing plate can jointly be installed in the housing.

If the annular cage is held by centering springs, such as spring buckles, in the recess in the backing plate, it will not be necessary to control the position of the polygonal arrays of balls as they are installed because the polygonal arrays of balls will automatically be positioned by the centering springs as the backing plates are installed.

DETAILED DESCRIPTION OF THE PREFERRED EMBODIMENT

Figure 1:
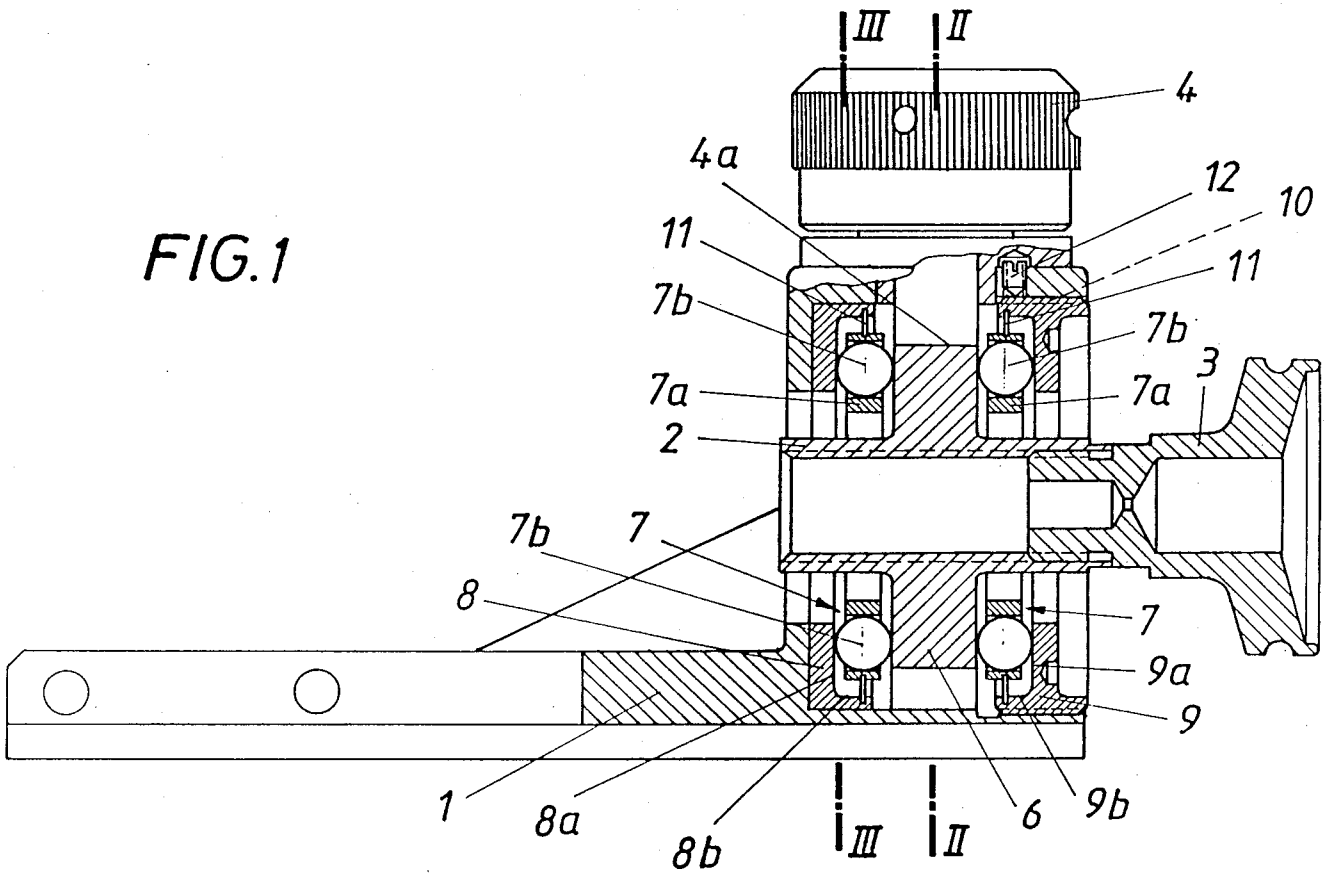
FIG. 1 is a longitudinal sectional view showing a sight which embodies the invention.
Figure 2:
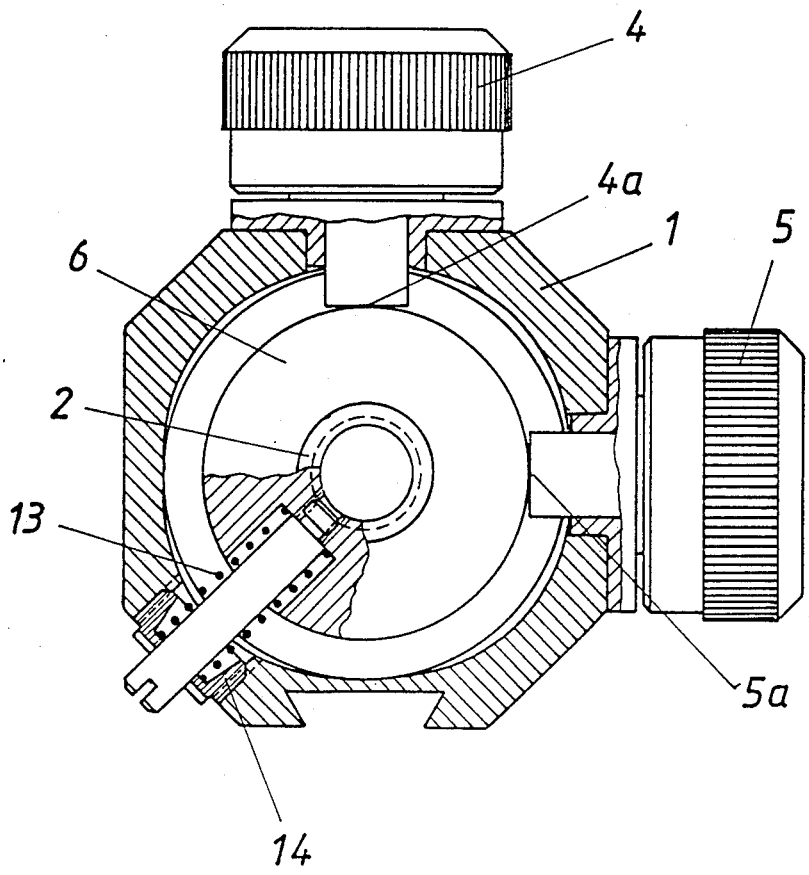
FIGS. 2 and 3 are transverse sectional views taken on lines II—II and III—III, respectively in FIG. 1.
Figure 3:
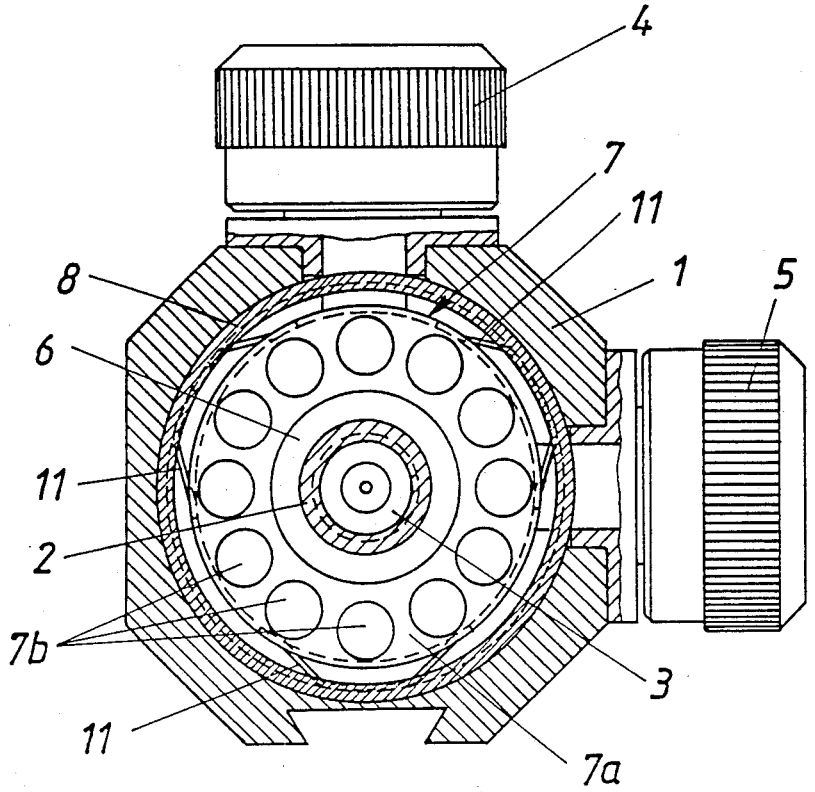

An illustrative embodiment of the invention will now be described more in detail with reference to the drawing.

A rifle sight comprises a frame or housing 1, which is adapted to be mounted on a rifle, not shown, adjacent to the rear end of the barrel. An adjustable member is constituted by an eyepiece carrier 2, which carries an eyepiece, such as a peephole sight 3, and which is mounted in the housing 1 for an adjustment by means of two actuators consisting of adjusting screws 4, 5 in two orthogonal directions. To ensure that such adjustment can easily be effected and that the eyepiece carrier will exactly be guided without a backlash, the eyepiece carrier 2 comprises a guided plate 6, which has parallel plane surfaces on opposite sides and generally extends in an adjusting plane, which contains the axes of the adjusting screws 4, 5. The guided plate 6 is gripped between two backing plates 8 and 9. A polygonal array of balls 7 is disposed between the guided plate 6 and each of the backing plates 8, 9. The backing plates 8, 9 are formed with respective guiding surfaces 8*a*, 9*a*, which are parallel to the guided plate 6 and in rolling contact with the polygonal array of balls 7. The backing plate 8 is fixedly supported in the housing 1. The backing plate 9 has been screwed into the housing 10 by means of screw threads 10 so that the guided plate 6, the polygonal array of balls 7 and the backing plates 8, 9 are forced together in the housing 1 without any backlash.

To facilitate the assembling, each of the polygonal arrays of balls 7 comprises a plurality of balls 7*b*, which are rotatably held in an annular cage 7*a*, and each polygonal array of balls 7 is received by a recess 8*b* or 9*b* of the associated backing plate 8 or 9 and is centered in said recess by spring buckles 11. As a result, each polygonal array of balls can be installed and removed together with the associated backing plate. The guiding surfaces 8*a*, 9*a* are constituted by the bottoms of the recesses 8*b* and 9*b*. When the backing plate 9 has been screwed into the housing 1, said backing plate is clamped in position by a fixing screw 12 so that an undesired loosening of the guided plate 6 which has been gripped and development of a backlash will be precluded.

The eyepiece carrier 2 is adjsutable by the adjusting screws 4, 5, which are mounted and guided in the housing 1 by suitable means, which are not shown in detail. Each of the adjusting screws 4 and 5 has an inner end face 4*a* or 5*a*, which is normal to the axis of the screw and engage the peripheral surface of the guided plate 6. That peripheral suface has a substantial width transversely to the adjusting plane in which the guided plate 6 is adjustable. A compensating spring 13 is provided, which exerts on the guided plate 6 a force substantially along the bisector of the angle that is included by the axes of the adjusting screws 4 and 5 so that the peripheral surface of the guided plate 6 is snugly urged against the inner end faces 4*a*, 5*a* of both adjusting screws 4 and 5. The initial stress of the compensating spring 13 can be varied by an adjusting nut 14. This arrangement will ensure a backlash-free contact between the guided plate 6 and the end faces 4*a* and 5*a*. As either of the adjusting screws 4 and 5 is screwed inwardly, the guided plate 6 and the eyepiece carrier 2 will be moved in the above-mentioned adjusting plane in the axial direction of said screw 4 or 5 against the force of the compensating spring 13. As either of the adjusting screws 4 and 5 is retracted, the compensating spring 13 will cause the guided plate 6 and the eyepiece carrier 2 to follow the movement of said adjusting screw 4 or 5.

Because the guided plate 6 of the sight in accordance with the invention is backed on both sides by means of the polygonal arrays of balls 7, the adjustment of the guided plate 6 will involve only rolling friction and will not involve any backlash in a direction that is normal to the guided plate 6. This will ensure that a highly exact adjustment of the eyepiece carrier 2 can very easily be effected owing to the provision of the polygonal array of balls 7. The structure of the sight is rugged and will not be affected by shakes and vibrations. Besides, the sight represents a low structural expenditure and can be made at relatively low costs.

It will be appreciated that the backing plates 8 and 9 and the two polygonal arrays of balls 7 constitute constraining means, which prevent a movement of the guided plate 6 relative to the frame or housing 1 in a direction which is transverse to the adjusting plane in which the guided plate 6 is adjustable in two orthogonal directions by the actuators consisting of the adjusting screws 4 and 5.

Whereas the embodiment of the invention described hereinbefore constitutes a rifle sight, it will be appreciated by persons skilled in the art that substantial advantages can be obtained by the use of orthogonal adjusting mechanisms in accordance with the invention for other purposes.

I claim:

1. An orthogonal adjusting mechanism comprising a frame, an adjustable member, which is mounted within said frame for a movement relative to said frame at least in two orthogonal directions in a predetermined adjusting plane, two actuators, which are mounted on said frame and coupled to said adjustable member and operable to move said adjustable member in two orthogonal directions in said adjusting plane relative to said frame, said adjustable member comprising a guided plate having two planar surfaces, which are parallel to said adjusting plane and disposed on opposite sides of said guided plate, and constraining means for preventing a movement of said guided plate relative to said frame in a direction which is transverse to said adjusting plane and comprise two backing structures, which are provided in said frame on opposite sides of said guided plate and have respective backing surfaces, which are parallel to and face respective ones of said planar surfaces of said guided plate, and a polygonal array of balls, which are disposed between and in rolling contact with each of said backing surfaces and the adjacent one of said planar surfaces of said guided plate.

2. The adjusting mechanism set forth in claim 1, wherein said balls are in pressure contact with said backing surfaces and said planar surfaces.

3. The adjusting mechanism set forth in claim 1, wherein said backing structures comprise two backing plates, which are mounted in said frame.

4. The adjusting mechanism set forth in claim 3, wherein one of said backing plates is held in said frame against a movement which is transverse to said adjusting plane and the other of said backing plates is held in said housing by cooperating screws threads provided on said other backing plate and in said frame.

5. The adjusting mechanism set forth in claim 1 wherein said actuators comprise two adjusting screws, which are mounted on said frame and have axes extending substantially in said adjusting plane in said two orthogonal directions, respectively, wherein said guided plate has a peripheral surface, which has a substantial width transversely to said adjusting plane, each of said adjusting screws has an inner end face, which is normal to the axis of said screws and engages said peripheral surface, and spring means are provided for urging said guided plate peripheral surface of said guided plate against said inner end faces of both said adjusting screws.

6. The adjusting mechanism set forth in claim 5, wherein said spring means comprise a single spring arranged to exert a force on said guided plate substantially along a line which is a bisector of the angle that is included by the axes of said adjusting screws.

7. The adjusting mechanism set forth in claim 1, wherein each of said polygonal arrays of balls comprises at least three balls, the balls of each of said arrays are rotatably mounted in an annular cage, each of said backing plates is formed with a circular recess having a bottom which constitutes one of said backing surfaces, and each of said polygonal arrays of balls together with the associated one of said annular cages extends in one of said recesses.

8. The adjusting mechanism set forth in claim 7, wherein spring means are provided for retaining and centering each of said annular cages in the associated one of said recesses.

9. The adjusting mechanism set forth in claim 1, wherein said frame comprises a housing.

10. An orthogonally adjustable sight for defining a sight line, comprising a frame an adjustable eyepiece carrier, which is mounted within said frame for a movement relative to said frame at least in two orthogonal directions in a predetermined adjusting plane, which is transverse to said sight line, and two actuators, which are mounted on said frame and coupled to said eyepiece carrier and operable to move said eyepiece carrier in two orthogonal directions in said adjusting plane relative to said frame, said eyepiece carrier comprising a guided plate having two planar surfaces, which are parallel to said adjusting plane and disposed on opposite sides of said guided plate, and constraining means for preventing a movement of said guided plate relative to said frame in a direction which is transverse to said adjusting plane and comprise two backing structures, which are provided in said frame on opposite sides of said guided plate and have respective backing surfaces, which are parallel to and face respective ones of said planar surfaces of said guided plate, and a polygonal array of balls, which are disposed between and in rolling contact with each of said backing surfaces and the adjacent one of said planar surfaces of said guided plate.

11. The adjustable sight set forth in claim 10, wherein said frame constitutes a housing.

12. The adjustable sight set forth in claim 10 comprising a rifle sight.

13. The adjustable sight set forth in claim 10 comprising a sight in which an eyepiece comprising a peephole sight is mounted in said eyepiece carrier.

* * * * *